US008592683B2

(12) United States Patent
Sato et al.

(10) Patent No.: US 8,592,683 B2
(45) Date of Patent: Nov. 26, 2013

(54) INSULATED ELECTRIC WIRE AND WIRING HARNESS

(75) Inventors: Masashi Sato, Yokkaichi (JP); Masato Inoue, Yokkaichi (JP); Soichirou Tsukamoto, Yokkaichi (JP)

(73) Assignees: Autonetworks Technologies, Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 263 days.

(21) Appl. No.: 12/734,422

(22) PCT Filed: Jan. 29, 2009

(86) PCT No.: PCT/JP2009/051453

§ 371 (c)(1),
(2), (4) Date: Apr. 30, 2010

(87) PCT Pub. No.: WO2009/096461

PCT Pub. Date: Aug. 6, 2009

(65) Prior Publication Data

US 2010/0252322 A1 Oct. 7, 2010

(30) Foreign Application Priority Data

Jan. 31, 2008 (JP) ..... 2008-020730

(51) Int. Cl.
*H01B 7/00* (2006.01)

(52) U.S. Cl.
USPC ..... 174/110 R; 174/110 N

(58) Field of Classification Search
USPC ..... 174/36, 110 R–110 PM
See application file for complete search history.

(56) References Cited

U.S. PATENT DOCUMENTS

| | | | | | |
|---|---|---|---|---|---|
| 4,521,485 | A | * | 6/1985 | Tondre et al. | 428/383 |
| 5,358,786 | A | * | 10/1994 | Ishikawa et al. | 428/380 |
| 5,364,898 | A | * | 11/1994 | Lee et al. | 524/265 |
| 5,397,822 | A | * | 3/1995 | Lee, Jr. | 524/127 |
| 5,521,009 | A | * | 5/1996 | Ishikawa et al. | 428/375 |
| 6,075,100 | A | | 6/2000 | El-Hibri | |
| 6,359,230 | B1 | * | 3/2002 | Hildreth | 174/110 R |
| 6,645,623 | B2 | | 11/2003 | Dean et al. | |
| 6,881,816 | B2 | | 4/2005 | Gharda et al. | |

(Continued)

FOREIGN PATENT DOCUMENTS

| | | | | | |
|---|---|---|---|---|---|
| CN | 1499537 | A | | 5/2004 | |
| JP | 02-273411 | A | * | 11/1990 | H01B 7/00 |

(Continued)

OTHER PUBLICATIONS

"1000 Examples of Appliance Repairing Skills and Improvements," edited by House of Electronics Digest Newspaper and Journal of Family Electronics, Apr. 30, 1995, p. 316.

(Continued)

*Primary Examiner* — William H Mayo, III
(74) *Attorney, Agent, or Firm* — Oliff & Berridge, PLC

(57) ABSTRACT

An insulated electric wire having an external diameter of less than 1.1 mm includes a conductor and an insulator that covers the conductor, and the insulator has a thickness of 0.25 mm or less, and is made from a material that is free from a halogen element and has a breaking elongation of 10% or more and a flexural modulus of more than 2.0 GPa.

12 Claims, 1 Drawing Sheet

(56) References Cited

U.S. PATENT DOCUMENTS

| | | | | |
|---|---|---|---|---|
| 7,297,872 | B2 * | 11/2007 | Morijiri | 174/88 C |
| 2001/0022234 | A1 * | 9/2001 | Okumura et al. | 174/78 |
| 2004/0102551 | A1 | 5/2004 | Sato et al. | |
| 2004/0168820 | A1 | 9/2004 | Kanamori et al. | |
| 2004/0231883 | A1 | 11/2004 | Kondo et al. | |
| 2005/0115738 | A1 * | 6/2005 | Yamaguchi et al. | 174/102 R |

FOREIGN PATENT DOCUMENTS

| | | |
|---|---|---|
| JP | A-2-273411 | 11/1990 |
| JP | A-2001-256836 | 9/2001 |
| JP | A-2002-298657 | 10/2002 |
| JP | A-2002-309048 | 10/2002 |
| JP | A-2004-161929 | 6/2004 |
| JP | A-2004-288625 | 10/2004 |
| JP | A-2006-185683 | 7/2006 |
| JP | A-2006-310213 | 11/2006 |

OTHER PUBLICATIONS

Chinese Office Action issued Sep. 15, 2011 in Chinese Patent Application No. 200980101466.8 (with translation).

Honma, Plastic Pocket Book, Mar. 15, 2003, pp. 126-127, Kogyo Chosakai Publishing Inc. (with translation).

Apr. 7, 2009 Search Report issued in International Patent Application No. PCT/JP2009/051453 (with translation).

Chinese Office Action issued in Chinese Patent Application No. 200980101466.8 dated Apr. 26, 2011 (w/ translation).

"*Resin and Plastic*" Editorial Board of Encyclopedia of Chemical Industry, Jan. 2003, p. 277, Chemical Industry Press.

Office Action issued in German Application No. 11 2009 000 262.5 dated Jul. 11, 2012 (with translation).

* cited by examiner

INSULATED ELECTRIC WIRE AND WIRING HARNESS

TECHNICAL FIELD

The present invention relates to an insulated electric wire having an external diameter of less than 1.1 mm to be used for wiring in an automobile or other devices, and a wiring harness using the same.

BACKGROUND ART

Conventionally, insulated electric wires that have a configuration such that an insulator that covers a conductor is made from a polyvinyl chloride resin for the purpose of obtaining flexibility are in widespread use. Recently, insulated electric wires that have a configuration such that an insulator that covers a conductor is made not from a polyvinyl chloride resin but from a composition containing a polyolefin resin such as polyethylene, polypropylene and alpha-olefin principally, and a flame retardant additionally have been proposed (see Japanese Patent Application Laid-Open No. 2002-309048, for example,).

The insulated electric wire disclosed in Japanese Patent Application Laid-Open No. 2002-309048 has a configuration such that an insulator that covers a conductor is made from a specific resin composition having a flexural modulus of not more than 2,000 MPa for the purpose of obtaining flexibility.

DISCLOSURE OF THE INVENTION

Problem to be Solved by the Invention

Insulated electric wires and wiring harnesses to be used in automobiles or other devices need to be thin-walled and reduced in external diameter for the purpose of reducing wiring space and weight reduction. However, if the insulated electric wire disclosed in Japanese Patent Application Laid-Open No. 2002-309048 of which the insulator is made from the material having the flexural modulus of not more than 2,000 MPa is used reduced in external diameter, the insulated electric wire has, while having flexibility, a problem that when a terminal of the insulated electric wire is inserted into a connector, the insulated electric wire buckles, and the insertion thus fails.

An object of the invention is to overcome the problem described above and to provide an insulated electric wire that has no possibility of buckling when the terminal is inserted into a connector even if the insulated electric wire has a reduced external diameter of less than 1.1 mm, allowing the insertion to be performed easily.

Means for Solving Problem

To achieve the objects and in accordance with the purpose of the present invention, an insulated electric wire having an external diameter of less than 1.1 mm according to a preferred embodiment of the present invention includes a conductor and an insulator that covers the conductor, and the insulator has a thickness of 0.25 mm or less, and is made from a material that is free from a halogen element and has a breaking elongation of 10% or more and a flexural modulus of more than 2.0 GPa.

In another aspect of the present invention, a wiring harness includes the insulated electric wire.

Effects of the Invention

Having the configuration that the insulator has the thickness of 0.25 mm or less, and is made from the covering material that has the breaking elongation of 10% or more and the flexural modulus of more than 2.0 GPa, the insulated electric wire according to the preferred embodiment of the present invention has sufficient flexibility while having no possibility of buckling when the terminal is inserted into a connector even if the insulated electric wire has the reduced external diameter of less than 1.1 mm, allowing the insertion to be performed without fail. The insulated electric wire having the reduced external diameter and the wiring harness including the insulated electric wire contribute to weight reduction and space-saving of automobiles or other devices where the insulated electric wire and the wiring harness are used.

BEST MODE FOR CARRYING OUT THE INVENTION

Figure 1A:
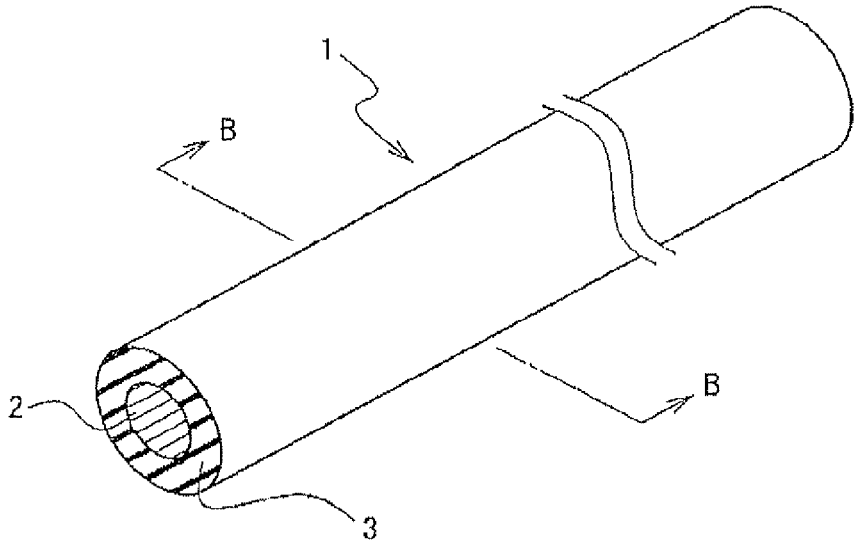
FIG. 1A is an external perspective view showing an insulated electric wire according to a preferred embodiment of the present invention.
Figure 1B:
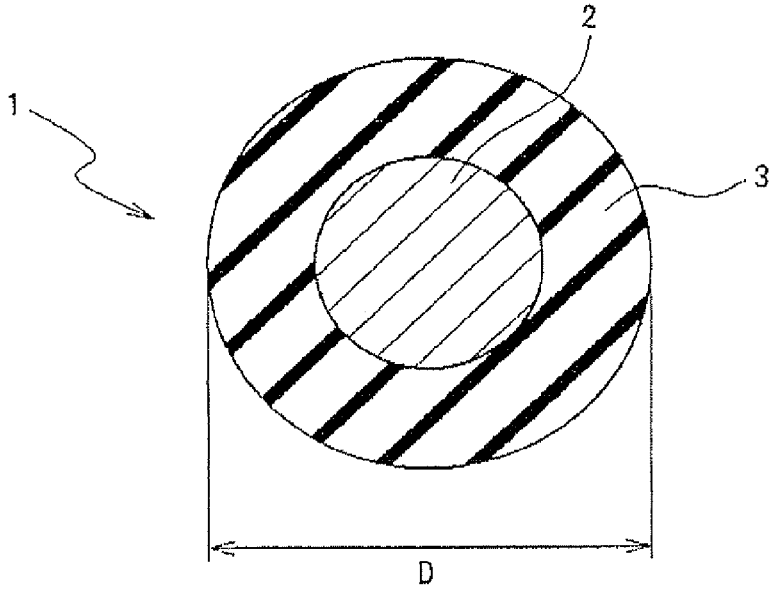
FIG. 1B is a cross-sectional view showing the same along the line B-B of FIG. 1A.

A detailed description of a preferred embodiment of the present invention will now be provided with reference to the accompanying drawings. FIG. 1A is an external perspective view showing an insulated electric wire according to the preferred embodiment of the present invention. FIG. 1B is a cross-sectional view showing the same along the line B-B of FIG. 1A. As shown in FIGS. 1A and 1B, an insulated electric wire 1 according to the preferred embodiment of the present invention has a configuration such that an insulator 3 covers a conductor 2 and the insulated electric wire 1 has an external diameter (D) of less than 1.1 mm.

The conductor 2 is preferably made of copper, aluminum, a copper alloy, an aluminum alloy, or stainless steel. The conductor 2 is preferably a single elemental wire, a strand of a plurality of elemental wires, or a compressed strand. If the conductor 2 is a strand of a plurality of elemental wires, elemental wires that are made from two or more than two different kinds of materials may be used in combination. The conductor 2 preferably has a cross-sectional area of 0.13 $mm^2$.

The insulator 3 is made from a covering material that is free from a halogen element such as chlorine and bromine. The covering material has a breaking elongation of 10% or more, and a flexural modulus of more than 2.0 GPa. The breaking elongation and the flexural modulus are values of the physical properties of the covering material. The breaking elongation is measured by a test method in accordance with ASTM D638. The flexural modulus is measured by a test method in accordance with ASTM D790.

The insulated electric wire 1 that includes the insulator 3 made from the covering material having the breaking elongation of 10% or more has sufficient flexibility, so that when the insulated electric wire 1 having the reduced external diameter is bent, no crack or fracture occurs in the insulator 3 and thus a reliable insulating property is achieved. The breaking elongation of the covering material is preferably 30% or more, and more preferably 50% or more.

The insulated electric wire 1 having the reduced external diameter that includes the insulator 3 made from the covering material having the flexural modulus of more than 2.0 GPa has no possibility of buckling when the terminal is inserted into a connector, so that the insertion is performed without fail, while an insulated electric wire having an external diameter of less than 1.1 mm that includes an insulator made from a covering material having a flexural modulus of 2.0 GPa or less has such a possibility.

The insulator 3 has a standard thickness of 0.25 mm or less. If the thickness is more than 0.25 mm, the insulator 3 is not sufficiently thin-walled. In addition, if the thickness is more than 0.25 mm, the conductor 2 becomes too thin and could have insufficient conductivity The thickness is preferably 0.1 mm or more. This is because if the thickness is less than 0.1 mm, it is difficult to uniformly form a coating of the insulator 3 and the insulator 3 might not deliver sufficient insulation performance.

The covering material for the insulator 3 is not limited specifically, and it is essential only that the covering material should have an insulating property, be free from a halogen element, and satisfy the breaking elongation and the flexural modulus that are specified above. The covering material is preferably made from a resin composition that contains a polymer principally. The contained polymer may be of one kind, or a blend of two or more kinds. The contained polymer may be a glass-fiber reinforced polymer.

A known additive for plastic may be added appropriately to the resin composition within a range of not impairing the above-described properties. Examples of the additive include a thermal stabilizer such as an antioxidant and an antiaging agent, a metal deactivator such as a copper inhibitor, a lubricant such as a fatty acid lubricant, a fatty acid amide lubricant, a metal soap lubricant, a hydrocarbon (wax type) lubricant, an ester lubricant and a silicone lubricant, a light stabilizer, a nucleating agent, an antistatic agent, a coloring agent, a hydrolyzability deactivator, a softener such as a processed oil, a zinc compound such as zinc oxide and zinc sulfide, a strengthening agent such as glass fiber, wallastonite, talc, bentonite, montmorillonite, carbon, calcium carbonate and a mineral, an inorganic flame retardant such as magnesium hydroxide and aluminum hydroxide, a nitrogen flame retardant such as melamine cyanurate, an Si-containing flame retardant, a phosphorus flame retardant such as a phosphoric ester, ammonium polyphosphate and red phosphorus, antimony trioxide, and a Zn-containing compound such as zinc nitrate. They may be used singly or in combination.

The insulator 3 may have a configuration of one layer made from the covering material of one kind. Alternatively, the insulator 3 may have a configuration of two or more layers made from the covering material of the same kind or the covering materials of different kinds.

For example, the insulator 3 is prepared such that the composition of the covering material is kneaded to be extruded onto the conductor 2 so as to have a given thickness. The kneading of the covering material may be performed preferably with the use of a double-shaft kneader in a manner such that all the ingredients are kneaded at a time, in a manner such that some of the ingredients are added halfway through the kneading from an intermediate feeder, or in a manner such that the kneading is performed in two steps in which some of the ingredients are added in the later step.

The insulated electric wire according to the preferred embodiment of the present invention has the form of a single wire as shown in FIGS. 1A and 1B; however, the present invention is not limited thereto, and the insulated electric wire may have the form of a flat wire or a shielded wire (not shown). In addition, in preparing a wiring harness including the insulated electric wire according to the preferred embodiment of the present invention, the form of the wiring harness can be varied according to the form of the insulated electric wire.

The insulated electric wire according to the preferred embodiment of the present invention can be used for an automobile, a device, information and telecommunications, electric power supply, a ship, or an aircraft, while most favorably used for an automobile.

EXAMPLES

Examples 1 to 9, Comparative Examples 1 to 8

Insulated electric wires according to Examples 1 to 9 and Comparative Examples 1 to 8 that have an external diameter of 0.85 mm were prepared as follows. Materials having the breaking elongations and the flexural moduli shown in Table 1 below were extruded as covering materials for insulators of the insulated electric wires onto conductors having a cross-sectional area of 0.13 $mm^2$ with the use of an extrusion molding machine such that the insulators covering the conductors had a thickness of 0.2 mm. A test to evaluate the flexibility of the obtained insulated electric wires by self-diameter winding, and a test to evaluate buckling stress of the obtained insulated electric wires were carried out. Results of the tests are shown in Table 1.

TABLE 1

| | Covering Material | | | Electric Wire Test Result | | |
|---|---|---|---|---|---|---|
| | | | | Flexibility by | | |
| | | Breaking Elongation | Flexural Modulus | Self-Diameter Winding | Buckling Stress | |
| | Type | (%) | (GPa) | Evaluation | (N) | Evaluation |
| Example 1 | Material 1 | 55 | 4.2 | PASSED | 13 | PASSED |
| Example 2 | Material 2 | 60 | 3.4 | PASSED | 12 | PASSED |
| Example 3 | Material 3 | 15 | 5.0 | PASSED | 14 | PASSED |
| Example 4 | Material 4 | 100 | 2.6 | PASSED | 10 | PASSED |
| Example 5 | Material 5 | 60 | 2.4 | PASSED | 10 | PASSED |
| Example 6 | Material 6 | 70 | 2.9 | PASSED | 11 | PASSED |
| Example 7 | Material 7 | 50 | 2.7 | PASSED | 11 | PASSED |
| Example 8 | Material 8 | 40 | 2.4 | PASSED | 10 | PASSED |
| Example 9 | Material 9 | 19 | 4.0 | PASSED | 13 | PASSED |
| Comparative Example 1 | Material 10 | 300< | 1.5 | PASSED | 8 | FAILED |
| Comparative Example 2 | Material 11 | 300< | 1.5 | PASSED | 9 | FAILED |

TABLE 1-continued

| | Covering Material | | | Electric Wire Test Result | | |
|---|---|---|---|---|---|---|
| | | | | Flexibility by | | |
| | | Breaking Elongation | Flexural Modulus | Self-Diameter Winding | Buckling Stress | |
| | Type | (%) | (GPa) | Evaluation | (N) | Evaluation |
| Comparative Example 3 | Material 12 | 5 | 5.1 | FAILED | 14 | PASSED |
| Comparative Example 4 | Material 13 | 2 | 11.0 | FAILED | 16 | PASSED |
| Comparative Example 5 | Material 14 | 6 | 4.5 | FAILED | 13 | PASSED |
| Comparative Example 6 | Material 15 | 32 | 1.8 | PASSED | 9 | FAILED |
| Comparative Example 7 | Material 16 | 48 | 1.0 | PASSED | 7 | FAILED |
| Comparative Example 8 | Material 17 | 150 | 1.6 | PASSED | 8 | FAILED |

Types of Covering Materials in Table 1

Material 1: PEEK 151G (Polyether ether ketone, manuf.: VICTREX PLC.)

Material 2: ULTEM 1000 (Polyether imide, manuf.: SABIC INNOVATIVE PLASTICS HOLDING BV)

Material 3: TORLON 4203L (Polyamide imide, manuf.: SOLVAY ADVANCED POLYMERS K.K.)

Material 4: DURANEX 2002 (Polybutylene terephthalate, manuf.: WIN TECH POLYMER LTD.)

Material 5: RADEL R-5800 (Polyphenyl sulfone, manuf.: SOLVAY ADVANCED POLYMERS K.K.)

Material 6: RADEL A-300A (Polyether sulfone, manuf.: SOLVAY ADVANCED POLYMERS K.K.)

Material 7: UDEL P-1700NT (Polysulfone, manuf.: SOLVAY ADVANCED POLYMERS K.K.)

Material 8: XYRON 500H (Modified polyphenylene ether, manuf.: ASAHI KASEI CORPORATION)

Material 9: XYRON X251V (Modified polyphenylene ether, manuf.: ASAHI KASEI CORPORATION)

Material 10: NOVATEC HY540 (Polyethylene, manuf.: JAPAN POLYETHYLENE CORPORATION)

Material 11: NOVATEC FY6 (Polypropylene, manuf.: JAPAN POLYPROPYLENE CORPORATION)

Material 12: TORAYCON 1201G-15 (Polybutylene terephthalate, manuf.: TORAY INDUSTRIES., INC.)

Material 13: PEEK151GL30 (Polyether ether ketone, manuf.: VICTREX PLC.)

Material 14: ULTEM2100 (Polyether imide, manuf.: GE PLASTICS JAPAN LTD.)

Material 15: TPX RT31 (Polymethylpentene, manuf.: Mitsui Chemicals, Inc.,)

Material 16: TPX MX004 (Polymethylpentene, manuf.: Mitsui Chemicals, Inc.,)

Material 17: XYRON EV102 (Modified polyphenylene ether, manuf.: ASAHI KASEI CORPORATION)

A method of the evaluation test of the insulated electric wires is described. Note that the breaking elongations of the covering materials shown in Table 1 were measured by a test method in accordance with ASTM D638, and the flexural moduli of the covering materials shown in Table 1 were measured by a test method in accordance with ASTM D790.

Flexibility Test by Self-Diameter Winding

A self-diameter winding test was carried out to evaluate the flexibility of each insulated electric wire. The insulated electric wires were each wound three times around a mandrel having a diameter same as the external diameter of the insulated electric wires, and appearances of the insulated electric wires were observed. Among the observed insulated electric wires, the insulated electric wires that did not have in their insulators a crack or a fracture through which the conductors inside could be exposed were subjected to a withstand voltage test in which a voltage of 1 kV was applied to the wound insulated electric wires for 1 minute. The insulated electric wires that did not have a crack or an exposed portion in their appearances and were not broken down in the withstand voltage test were evaluated as PASSED. The insulated electric wires that had a crack or an exposed portion in their appearances or were broken down in the withstand voltage test were evaluated as FAILED.

Buckling Stress Test

The insulated electric wires were each held at positions 10 mm apart from their ends, and pressed in a vertical direction against a flat plate at a given constant speed (200 mm/min) until the insulated electric wires buckled. Loads that were applied to the insulated electric wires at the time when the insulated electric wires buckled were measured. The measured loads define buckling stresses (N) of the insulated electric wires. The buckling stress test is intended to evaluate the degrees of buckling of the insulated electric wires at the time when the terminals of the insulated electric wires are inserted into a connector. A larger numerical value of the buckling stress indicates lower possibility of buckling. Judging that the ends of insulated electric wires having a buckling stress of 10 N or more could be inserted into a connector in a favorable manner in the actual insertion, the insulated electric wires having a buckling stress of 10 N or more were evaluated as PASSED while the insulated electric wires having a buckling stress of less than 10 N were evaluated as FAILED.

Therefore, as shown in Table 1, since the insulated electric wires according to Examples 1 to 9 include the insulators that are made from the covering materials having the breaking elongations and the flexural moduli that are specified in the preferred embodiment of the present invention, the results of both of the flexibility evaluation test by self-diameter winding and the buckling stress evaluation test were favorable. In contrast, since the insulated electric wires according to Comparative Examples 1, 2 and 6 to 8 include the insulators that are made from the covering materials having flexural moduli less than the values specified in the preferred embodiment of the present invention, the results of the buckling stress evaluation test were FAILED. In addition, since the insulated electric wires according to Comparative Examples 3 to 5 include the insulators that are made from the covering materials having breaking elongations deviating from the values specified in the preferred embodiment of the present invention, the results of the flexibility evaluation test by self-diameter winding were FAILED. The test results of the insulated electric wires according to Comparative Examples 1 to 8 show that an insulated electric wire that can pass both of the flexibility evaluation test by self-diameter winding and the buckling stress evaluation test cannot be obtained if it includes an insulator that is made from a covering material having a breaking elongation and a flexural modulus either of which deviates from the values specified in the preferred embodiment of the present invention.

The invention claimed is:

1. An insulated electric wire having an external diameter of less than 1.1 mm, the wire comprising:

a conductor; and an insulator that covers the conductor, the insulator having a thickness of 0.25 mm or less, and being made from an insulator material that is free from a halogen element, the insulator material being selected from the group consisting of (1) polyether ether ketone, (2) polyether imide, (3) polyamide imide and (4) modified polyphenylene ether composed of polyphenylene ether and polystyrene, and the insulator material having a breaking elongation of 10% or more and a flexural modulus of more than 3.0 GPa.

2. The insulated electric wire according to claim 1, wherein the wire has a buckling stress of 12 N or more, where the buckling stress is defined by a load that is applied to the wire at the time when the wire buckles under conditions that the wire is held at a position 10 mm apart from its end, and pressed in a vertical direction against a flat plate at a speed of 200 mm/min.

3. The insulated electric wire according to claim 2, wherein the insulator has no crack or fracture and has no insulation breakdown when the wire is wound around a mandrel having a diameter same as the external diameter of the wire and a voltage of 1 kV is applied to the wound wire for 1 minute.

4. A wiring harness comprising the insulated electric wire according to claim 2.

5. A wiring harness comprising the insulated electric wire according to claim 3.

6. The insulated electric wire according to claim 1, wherein the insulator has no crack or fracture and has no insulation breakdown when the wire is wound around a mandrel having a diameter same as the external diameter of the wire and a voltage of 1 kV is applied to the wound wire for 1 minute.

7. A wiring harness comprising the insulated electric wire according to claim 6.

8. A wiring harness comprising the insulated electric wire according to claim 1.

9. The insulated electric wire according to claim 1, wherein the insulator material is polyether ether ketone.

10. The insulated electric wire according to claim 1, wherein the insulator material is polyether imide.

11. The insulated electric wire according to claim 1, wherein the insulator material is polyamide imide.

12. The insulated electric wire according to claim 1, wherein the insulator material is modified polyphenylene ether composed of polyphenylene ether and polystyrene.

* * * * *